US007846856B2

(12) United States Patent
Ghosh et al.

(10) Patent No.: US 7,846,856 B2
(45) Date of Patent: Dec. 7, 2010

(54) METHOD OF MAKING A FIBER CONTAINING AN ANTIMICROBIAL COMPOSITION

(75) Inventors: Tirthankar Ghosh, Oreland, PA (US); Barry Weinstein, Dresher, PA (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 12/759,945

(22) Filed: Apr. 14, 2010

(65) Prior Publication Data

US 2010/0190404 A1 Jul. 29, 2010

Related U.S. Application Data

(62) Division of application No. 11/482,142, filed on Jul. 6, 2006, now abandoned.

(60) Provisional application No. 60/697,170, filed on Jul. 7, 2005.

(51) Int. Cl.

| | |
|---|---|
| ***D04H 1/00*** | (2006.01) |
| ***D04H 3/00*** | (2006.01) |
| ***D04H 5/00*** | (2006.01) |
| ***D04H 13/00*** | (2006.01) |
| ***D03D 15/00*** | (2006.01) |
| ***D04B 21/14*** | (2006.01) |
| ***D02G 3/00*** | (2006.01) |
| ***B32B 9/00*** | (2006.01) |
| ***D21F 11/00*** | (2006.01) |

(52) U.S. Cl. ..... 442/361; 442/199; 442/311; 428/364; 428/373; 162/157.2

(58) Field of Classification Search ..... 8/115.51; 19/144; 442/199, 311, 361; 428/364, 373; 162/157.2

See application file for complete search history.

(56) References Cited

U.S. PATENT DOCUMENTS

| | | | |
|---|---|---|---|
| 4,104,227 | A | 8/1978 | Boessler et al. |
| 4,891,391 | A | 1/1990 | McEntee |
| 5,208,016 | A | 5/1993 | Ohmae et al. |
| 5,405,644 | A | 4/1995 | Obsumi et al. |
| 5,876,489 | A | 3/1999 | Kunisaki et al. |
| 5,945,032 | A | 8/1999 | Breitenbach et al. |
| 6,153,210 | A | 11/2000 | Roberts et al. |
| 6,723,428 | B1 | 4/2004 | Foss et al. |
| 7,335,613 | B2 | 2/2008 | Cottrell et al. |
| 2003/0044447 | A1 | 3/2003 | Zanini et al. |
| 2003/0186955 | A1 | 10/2003 | Vange et al. |
| 2004/0001880 | A1 | 1/2004 | Bowler et al. |
| 2004/0150788 | A1 | 8/2004 | Andersson et al. |
| 2004/0151755 | A1 | 8/2004 | Rathore et al. |
| 2005/0064020 | A1 | 3/2005 | Schuette et al. |
| 2005/0123621 | A1 | 6/2005 | Burton et al. |
| 2005/0124724 | A1 | 6/2005 | Burton et al. |
| 2005/0226914 | A1 | 10/2005 | Cottrell et al. |
| 2005/0227895 | A1 | 10/2005 | Ghosh et al. |
| 2008/0058393 | A1 | 3/2008 | Kobara Pestell et al. |

FOREIGN PATENT DOCUMENTS

| | | |
|---|---|---|
| EP | 0905289 | 3/1999 |
| JP | 05-277143 | 10/1993 |
| JP | H11222402 | 8/1999 |
| JP | 2001-106961 | 4/2001 |
| JP | 2001097806 | 4/2001 |
| JP | 2004510794 | 4/2004 |
| WO | 03025266 | 3/2003 |

OTHER PUBLICATIONS

Melaiye, et al., Silver(I)-Imidazole Cyclophane gem-Diol Complexes, Journal of American Chemical Society, vol. 127, No. 7, pp. 2285-2291 (2005).

Miyajima, et al., On the Complexation of Ag(I) and Cu(II) ions with poly (N vinylimidazole), Reactive and Functional 38 (1998) 183-195.

Journal of Inorganic Biochemistry (1997), 68(1), 39-44.

Patent Abstracts of Japan, vol. 018, No. 615 (C-1277), Nov. 24, 1994 JP 06 235116A, Asahi Chem Ind Co Ltd, Aug. 23, 1994.

*Primary Examiner*—Lorna M Douyon
*Assistant Examiner*—Tanisha Diggs
(74) *Attorney, Agent, or Firm*—Thomas S. Deibert

(57) ABSTRACT

Fibers that durably contain antimicrobial materials such that the antimicrobial materials are resistant to being abraided away or washed off during use. The antimicrobial materials contained in the fibers are not prone to the development of resistant strains of bacteria. Also disclosed are methods of making and using the fibers.

6 Claims, No Drawings

METHOD OF MAKING A FIBER CONTAINING AN ANTIMICROBIAL COMPOSITION

This is a division of application Ser. No. 11/482,142, filed on Jul. 6, 2006, now abandoned; which claims the benefit of U.S. Provisional Application No. 60/697,170, filed on Jul. 7, 2005.

The present invention relates to fibers containing an antimicrobial composition and to methods of making and using the same.

Microorganisms exist all around us. The potential repercussions to human health presented by many such microorganisms have made antimicrobial formulations an ubiquitous part of commercial and residential cleaning and disinfection processes. Some such repercussions may include, for example, illnesses and skin infections attributed to *Staphylococcus aureus, Klebsiella pneumoniae*, yeast and other unicellular organisms that may be present and multiply rapidly in our clothing and other fabrics we come into contact with and use everyday. Many conventional antimicrobial compositions, however, are unsuitable for durable use on such fabric surfaces. As a result, there is a perceived need for fibers and fabrics made therewith that exhibit antimicrobial properties.

One approach to providing fibers that exhibit antimicrobial properties is provided by Foss et al. in U.S. Pat. No. 6,841,244. Foss et al. disclose an antimicrobial synthetic fiber that comprises various thermoplastic polymers and additives in a bi-component form in either a core-sheath or side-by-side configuration. The fibers disclosed by Foss et al. comprise inorganic anti-microbial additives, distributed in certain areas of the fiber to reduce the amount of the antimicrobial agents being used, and therefore the cost of such fiber's. The antimicrobial agents disclosed by Foss et al. are inorganic compounds containing copper, zinc, tin and/or silver. Foss et al. teach that the best results are obtained using a zeolite of silver.

Nevertheless, there remains a need for new fibers and fabrics that durably contain antimicrobial materials such that these antimicrobial materials are resistant to being abraded away or washed off during their intended use. There also remains a need for new fibers and fabrics that durably contain antimicrobial materials, which materials are not prone to the development of resistant strains of bacteria.

In one aspect of the present invention, there is provided a fiber comprising a component polymer composition and an antimicrobial composition, wherein the antimicrobial composition comprises a metal complexed with a complexing polymer, wherein the metal is selected from copper, silver, gold, tin, zinc and combinations thereof; and, wherein the complexing polymer comprises monomer residues selected from residue A, residue B, residue C and combinations thereof; optionally, with the proviso that the complexing polymer contains ≦99.5 wt % (alternatively, ≦99 wt %; alternatively, ≦98 wt %; alternatively, ≦95 wt %; alternatively, ≦90 wt %; alternatively, ≦85 wt %; alternatively, ≦80 wt %; alternatively, ≦75 wt %; alternatively, ≦70 wt %) of monomer residues of residue B;

wherein residue A is

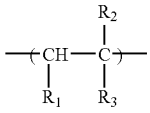

wherein residue B is

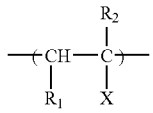

wherein residue C is

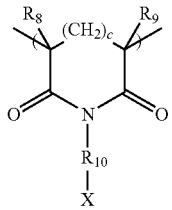

wherein

X is an unsaturated or aromatic heterocycle having at least one hetero atom selected from N, O and S;

c is 0 or 1;

$R_1$ is selected from H, $CH_3$ and —$CO_2R_4$; where $R_4$ is selected from H, $CH_3$, $C_2H_5$, a $C_3$-$C_{24}$ alkyl;

$R_2$ is selected from H, $CH_3$, $C_2H_5$, phenyl, —$CH_2CO_2R_5$ and —$CO_2R_5$; where $R_5$ is selected from (I)-(V), (I) H;

(II)

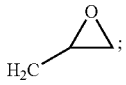

(III) —$(CH_2CH(R_{11})O)_nH$;

(IV) —$(CH_2CH(R_{11})O)_nCOCH_2COCH_3$; and, (V)

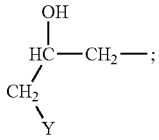

where $R_{11}$ is selected from H, methyl and phenyl; n is an integer from 1 to 20; Y is selected from OH, $SO_3Z$ and X; where Z is selected from H, sodium, potassium and $NH_4^+$; with the proviso that when the polymer contains 0 wt % of monomer residues of residue B and 0 wt % of monomer residues of residue C, $R_2$ is —$CH_2CO_2R_5$ or —$CO_2R_5$, $R_5$ is (V) and Y is X;

$R_3$ is selected from H, methyl, phenyl, sulfonated phenyl, phenol, acetate, hydroxy, a fragment O—$R_1$, where $R_1$ is as defined previously, —$CO_2R_{12}$ and —$CONR_6R_7$; where $R_6$ and $R_7$ are independently selected from H, methyl, ethyl, $C(CH_3)_2CH_2SO_3Z$, where Z is as defined previously, $C_3$-$C_8$ alkyl and a combined ring structure and $R_{12}$ is selected from H, $CH_3$, $C_2H_5$ and $C_3$-$C_{24}$ alkyl;

$R_8$ and $R_9$ are independently selected from hydrogen, methyl, ethyl and $C_3$-$C_4$ alkyl;

$R_{10}$ is selected from $C_1$-$C_8$ alkyl, $C_2$-$C_8$ alkenyl, $C_6$-$C_{10}$ unsaturated acyclic, $C_6$-$C_{10}$ cyclic, $C_6$-$C_{10}$ aromatic, $C_2$-$C_4$ alkylene oxide and poly ($C_2$-$C_4$ alkylene)$_b$ oxides; where b is an integer from 2 to 20.

In another aspect of the present invention, there is provided a multicomponent fiber comprising at least one component polymer composition and at least one antimicrobial composition.

In another aspect of the present invention, there is provided a multicomponent fiber comprising two or more component polymer compositions and an antimicrobial composition of the present invention as described above.

In another aspect of the present invention, there is provided a fabric comprising a fiber or a multicomponent fiber of the present invention.

In another aspect of the present invention, there is provided a textile product comprising a fabric of the present invention.

In another aspect of the present invention, there is provided a method for making a fiber or multicomponent fiber of the present invention, comprising (a) providing a component polymer composition;

(b) providing an antimicrobial composition of the present invention as described hereinabove;

(c) mixing the component polymer composition of (a) and the antimicrobial composition of (b); and, (d) forming the fiber using the product of (c).

The term "fiber" as used herein and in the appended claims refers to a unit of matter which is capable of being spun into a yarn or made into a fabric by bonding or by interlacing in a variety of ways including, for example, weaving, knitting, braiding, felting, twisting or webbing; and which is the basic structural element of textile products.

The term "initially free" as used herein and in the appended claims in reference to optional "additional fiber(s)" means that the additional fiber(s) is/are free of the antimicrobial composition of the present invention before incorporation with a fiber or multicomponent fiber of the present invention to form a fabric. Note, however, that some antimicrobial composition of the present invention may migrate to the additional fiber(s) subsequent to incorporation into a fabric containing a fiber or multicomponent fiber of the present invention.

The term "yarn" as used herein and in the appended claims refers to a strand of textile fiber in a form suitable for weaving, knitting, braiding, felting, twisting, webbing, or otherwise fabricating into a fabric.

The term "fabric" as used herein and in the appended claims refers to any material woven, knitted, felted, or otherwise produced from, or in combination with, any natural or manufactured fiber, yarn, or substitute therefor.

The term "sheath/core configuration" as used herein and in the appended claims encompass multicomponent fiber concentric sheath/core configurations and eccentric sheath/core configurations.

The term "side-by-side configuration" as used herein and in the appended claims refers to an extension of a multicomponent fiber eccentric sheath/core configuration in which both component polymers of the multicomponent fiber occupy a portion of the multicomponent fiber's surface.

The term "core shell configuration" may be used interchangeable herein with the term "sheath/core configuration".

The term "alkyl" as used herein and in the appended claims includes both straight chain, branched and cyclic alkyl groups.

The term "alkenyl" as used herein and in the appended claims includes both straight chain and branched chain alkenyl groups.

The term "(meth)acrylates" used herein and in the appended claims encompasses both methacrylates and acrylates.

In some embodiments, the component polymer compositions of the present invention comprise a polymer selected from polyolefins (e.g., polyethylene, polypropylene, polybutylene); halogenated polymers (e.g., polyvinyl chloride); polyesters (e.g., polyethylene terephthalate, polybutylene terephthalate (PBT)); polyethers; polyamides (e.g., nylon 6 and nylon 6,6); polyurethanes; cellulose acetates; rayon; acrylics; polyphenylene sulfide (PPS); and homopolymers, copolymers, multipolymers and blends thereof. In some aspects of these embodiments, the component polymer compositions of the present invention comprise a polymer selected from polyamide; polypropylene; polyethylene; polyethylene terephthalate; and homopolymers, copolymers, multipolymers and blends thereof. In some aspects of these embodiments, the component polymer compositions comprise a polymer selected from nylon 6; nylon 6,6; polypropylene; polyethylene; and homopolymers, copolymers, multipolymers and blends thereof. In some aspects of these embodiments, the component polymer compositions comprise a polymer selected from polyethylene; polypropylene; and homopolymers, copolymers, multipolymers and blends thereof.

In some embodiments of the present invention, the antimicrobial composition comprises a metal selected from copper, silver, gold, tin, zinc and combinations thereof. In some aspects of these embodiments, the metal is selected from copper, silver, gold and combinations thereof. In some aspects of these embodiments, the metal is selected from copper, silver, zinc and combinations thereof. In some aspects of these embodiments, the metal is a combination of copper and silver. In some aspects of these embodiments, the metal is a combination of zinc and silver. In some aspects of these embodiments, the metal is silver.

In some embodiments of the present invention, the complexing polymer comprises at least one monomer having at least one unsaturated or aromatic heterocyclic group. Unsaturated or aromatic heterocyclic groups suitable for use with the present invention include, for example, 5 to 7-membered heterocycles having some degree of unsaturation; aromatic heterocycles having at least one hetero atom selected from N, O and S atoms; isomers of such heterocycles and combinations thereof. Other heterocyclic groups suitable for use with the present invention include, for example, 5 to 7-membered heterocycles that are fused together to form larger 9 to 14 membered heterocycles having at least one N, O or S atom; isomers of such heterocycles and combinations thereof. Additional heterocyclic groups suitable for use with the present invention include 5 to 7-membered heterocycles that are fused with a carbocycle to form larger 9 to 14-membered heterocycles.

In some embodiments of the present invention, the complexing polymer comprises at least one unsaturated or aromatic heterocyclic group selected from imidazole thiophene; pyrrole; oxazole; thiazoles and their respective isomers (e.g., thiazol-4-yl, thiazol-3-yl and thiazol-2-yl); tetrazole; pyridine; pyridazine; pyrimidine; pyrazine; azoles; indazoles; triazoles and their respective isomers (e.g., 1,2,3-triazole and 1,2,4-triazole); and combinations thereof, such as imidazole 1,2,3-triazole-1,2,4-triazole; benzotriazole; methyl-benzotriazole; benzothiazole; methylbenzothiazole; benzimidazole and methyl benzimidazole. In some aspects of these embodiments, the complexing polymer comprises at least one heterocyclic group selected from imidazole, benzotriazole and benzimidazole. In some aspects of these embodiments, the complexing polymer comprises imidazole.

In some embodiments, the complexing polymer of the present invention comprises a copolymer of (a) a monomer containing an unsaturated or aromatic heterocyclic group and (b) a monomer not containing an unsaturated or aromatic heterocyclic group. In some aspects of these embodiments, the ratio of monomer (a) to the monomer of (b) in the complexing polymer is 95:5 to 5:95; alternatively 80:20 to 20:80; alternatively 60:40 to 40:60. In some aspects of these embodiments, the monomer of (a) is 1-vinylimidazole. In some aspects of these embodiments, the monomer of (a) is 1-vinylimidazole and the ratio of the monomer of (a) to the monomer of (b) is 95:5 to 5:95; alternatively 80:20 to 20:80; alternatively 60:40 to 40:60.

In some embodiments of the present invention, the antimicrobial compositions comprise a complexing polymer comprising at least one monomer containing an unsaturated or aromatic heterocyclic group complexed with silver. In some aspects of these embodiments, the weight ratio of the at least one monomer containing an unsaturated or aromatic heterocyclic group to silver is 95:5 to 5:95; alternatively 90:10 to 10:90; alternatively 80:20 to 20:80. In some aspects of these embodiments, the molar ratio of silver to the monomer containing an unsaturated or aromatic heterocyclic group is 10:1 to 1:10; alternatively 4:1 to 1:4; alternatively 2:1 to 1:2. In some aspects of these embodiments, the at least one monomer containing an unsaturated or aromatic heterocyclic group is 1-vinylimidazole.

In some embodiments of the present invention, the complexing polymer further comprises an, optional, crosslinking material. In some aspects of these embodiments, the complexing polymer may comprise at least 0.5 wt % crosslinking material; alternatively >2 wt % crosslinking material; alternatively >5 wt % crosslinking material; alternatively >8 wt % crosslinking material; alternatively >10 wt % crosslinking material; alternatively >20 wt % crosslinking material; alternatively >30 wt % crosslinking material; alternatively >40 wt % crosslinking material; alternatively >50 wt % crosslinking material; alternatively <60 wt % crosslinking material; alternatively 0.5 to 60 wt % crosslinking material; alternatively <0.1 wt % crosslinking material; alternatively 0 wt % crosslinking material.

Crosslinking materials suitable for use with the present invention include any known crosslinking material provided that the physical and chemical stability of the antimicrobial composition is substantially unaffected by inclusion of the crosslinking material. In some embodiments of the present invention, the antimicrobial compositions may comprise a polymer containing a multifunctional (meth)acrylate crosslinking material selected from allyl methacrylate (ALMA); divinylbenzene (DVB); ethyleneglycol diacrylate (EGDA); ethyleneglycol dimethacrylate (EGDMA); 1,3-butanediol dimethacrylate (BGDMA); diethyleneglycol dimethacrylate (DEGDMA); tripropyleneglycol diacrylate (TRPGDA); trimethylolpropane trimethacrylate (TMPTMA); trimethylolpropane triacrylate (TMPTA) and combinations thereof. In some aspects of these embodiments, the antimicrobial compositions may comprise a polymer containing a crosslinking material selected from TMPTMA, TMPTA and combinations thereof. In some aspects of these embodiments, the antimicrobial compositions may comprise a TMPTA crosslinking material.

In some embodiments of the present invention, the antimicrobial composition exhibits an average particle size of ≦200 nm; alternatively ≦150 nm; alternatively ≦100 nm; alternatively ≦75 nm; alternatively ≦50 nm; alternatively ≦25 nm; alternatively ≦20 nm; alternatively ≦15 nm; alternatively ≦10 nm; alternatively 1 to 10 nm; alternatively 1 to 8 nm; alternatively ≦5 nm.

In some embodiments of the present invention, the antimicrobial composition exhibits an average particle size that is ≦33% of the average cross-sectional area of the fiber containing the antimicrobial composition.

In some embodiments of the present invention, the antimicrobial composition comprises a complexing polymer exhibiting a number average molecular weight of ≦500,000; alternatively ≦100,000; alternatively ≦50,000; alternatively ≦10,000; alternatively 1,000 to 10,000; alternatively 5,000 to 10,000; alternatively 500 to 5,000.

In some embodiments of the present invention, the antimicrobial composition comprises silver. In some aspects of these embodiments, the antimicrobial composition comprises 0.5 to 60 wt % metal; alternatively 0.5 to 15 wt % metal; alternatively 20 to 100,000 ppm metal; alternatively ≧20 ppm metal; alternatively 20 to 4,000 ppm metal; alternatively 20 to 1,500 ppm metal; alternatively 30 to 75 ppm metal; alternatively ≧50 ppm metal. In some aspects of these embodiments, the metal is selected from copper, silver, zinc and combinations thereof. In some aspects of these embodiments, the metal is a combination of copper and silver. In some aspects of these embodiments, the metal is a combination of zinc and silver. In some aspects of these embodiments, the metal is silver.

In some embodiments of the present invention, the antimicrobial composition comprises silver and a complexing polymer comprising a copolymer of (a) 1-vinylimidazole and (b) at least one monomer that does not contain an unsaturated or aromatic heterocyclic group.

As used herein and in the appended claims, the term "silver" refers to silver metal that is incorporated into an antimicrobial composition of the present invention. While not wanting to be bound as to the oxidation state of the silver ($Ag^0$, $Ag^{1+}$ or $Ag^{2+}$) that is incorporated into the antimicrobial composition, silver may be added to the antimicrobial composition by washing the polymer in a silver solution such as silver nitrate in deionized water ("DI"). Aside from DI, other liquid media can also be used such as water, aqueous buffered solutions and organic solutions such as polyethers or alcohols. Other sources of silver include but are not limited to silver acetate, silver citrate, silver iodide, silver lactate, silver picrate and silver sulfate. The concentration of silver in these solutions can vary from the concentration required to add a known quantity of silver to the antimicrobial composition to a saturated silver solution.

In some embodiments of the present invention, the fiber or multicomponent fiber comprises ≧0.01 wt %; alternatively 0.01 to 30 wt %; alternatively 0.01 to 20 wt %; alternatively 0.1 to 15 wt %; alternatively 0.1 to 10 wt % antimicrobial composition.

In some embodiments of the present invention, the fiber or multicomponent fiber exhibits a metal concentration of ≧10 ppm; alternatively 10 to 1,000 ppm; alternatively 10 to 500 ppm; alternatively 10 to 400 ppm; alternatively 10 to 300 ppm; alternatively 10 to 250 ppm; alternatively 10 to 200 ppm; alternatively 10 to 150 ppm; alternatively 10 to 100 ppm; alternatively less than 100 ppm; alternatively 10 to 50 ppm. In some aspects of these embodiments, the metal is selected from copper, silver, zinc and combinations thereof. In some aspects of these embodiments, the metal is a combination of copper and silver. In some aspects of these embodiments, the metal is a combination of zinc and silver. In some, aspects of these embodiments, the metal is silver.

In some embodiments of the present invention, the fiber or multicomponent fiber further comprises at least one additive selected from fire retardants, colorants, pigments, dyes, tints, antistatic agents, brightening compounds, nucleating agents, antioxidants, UV stabilizers, fillers, softeners, lubricants, curing accelerators, hydrophilic materials, hydrophobic materials, anti-stain materials, anti-odor materials, antimicrobial agents, disinfecting agents.

In some embodiment of the present invention, the fiber or multicomponent fiber may optionally further comprise an antimicrobial agent as described above. Suitable antimicrobial agents may include, for example, any conventional antimicrobial agent provided that the physical and chemical stability of the fiber or multicomponent fiber is substantially unaffected by such inclusion. In some aspects of these embodiments, the antimicrobial agent may be selected from 3-isothiazolones; 3-iodo-2-propynylbutylcarbamate; 2-bromo-2-nitropropanediol; glutaric dialdehyde; 2-n-octyl-3-isothiazolone; 4,5-dichloro-2-n-octyl-3-isothiazolone; sodium 2-pyridinethiol-1-oxide; zinc 2-pyridinethiol-1-oxide; oxybisphenoxarsine; p-hydroxy benzoic acid alkyl ester; tris(hydroxymethyl)nitromethane; dimethylol-dimethyl-hydantion; benzisothiazolone; polyhexamethylenebiguanide; 2,4,4'-trichloro-2'-hydroxy-diphenyl ether; silver sodium hydrogen zirconium phosphate (e.g., AlphaSan®, available from Milliken & Company); silver zeolites (e.g. Zeomic® AJ, available from Sinanen); silver exchanged on calcium phosphate (e.g., Apiscider®, available from Sangi); silver glass (e.g., Ionopure®, available from Ishizuka Glass) and combinations thereof.

In some embodiment of the present invention, the fiber or multicomponent fiber may optionally further comprise a disinfecting agent. Suitable disinfecting agents may include, for example, any conventional disinfecting agent, provided that the physical and chemical stability of the fiber or multicomponent fiber is substantially unaffected by such inclusion. In some aspects of these embodiments, the disinfecting agent may be selected from alcohols (e.g., ethanol), quaternary ammonium disinfectants, phenolic disinfectants, halide based disinfectants (e.g., chlorine based disinfectants and bromine based disinfectants), biguanide disinfectants, chlorhexidine disinfectants, iodophor disinfectants, citric acid disinfectants, peroxide disinfectants and combinations thereof. In some aspects of these embodiments, the disinfecting agent may be selected from halide based disinfectants (e.g., N-halamines). In some aspects of these embodiments, the disinfecting agent may be selected from N-halamines, bleach, hydantoins and combinations thereof.

In some embodiments of the present invention, the multicomponent fiber comprises at least one component polymer composition and at least one antimicrobial composition. In some aspects of these embodiments, at least one of the at least one component polymer compositions and at least one of the at least one antimicrobial compositions are mixed.

In some embodiments of the present invention, the multicomponent fiber comprises two or more component polymer compositions and at least one antimicrobial composition. In some aspects of these embodiments, the two or more component polymer compositions exhibit different chemical or physical properties. In some aspects of these embodiments, at least one of the two or more component polymer compositions is mixed with at least one of the at least one antimicrobial compositions.

In some embodiments of the present invention, the multicomponent fiber exhibits a cross section selected from a sheath/core configuration, a side by side configuration, a pie wedge configuration, a hollow pie wedge configuration, a segmented ribon configuration, a segmented cross configuration, an islands-in-a-sea configuration, a tipped trilobal configuration and a conjugate configuration. In some aspects of these embodiments, the multicomponent fiber exhibits a sheath/core configuration. In some aspects of these embodiments, the multicomponent fiber exhibits a cross section selected from a pie wedge configuration; a hollow pie wedge configuration and an islands-in-a-sea configuration.

In some embodiments of the present invention, the multicomponent fiber exhibits a sheath/core configuration, wherein the sheath comprises an antimicrobial composition. In some aspects of these embodiments, the sheath exhibits a metal concentration of ≧10 ppm; alternatively 10 to 1,000; alternatively 10 to 500 ppm; alternatively 10 to 400 ppm; alternatively 10 to 300 ppm; alternatively 10 to 250 ppm; alternatively 10 to 200 ppm; alternatively 10 to 150 ppm; alternatively 10 to 100 ppm; alternatively less than 100 ppm; alternatively 10 to 50 ppm. In some aspects of these embodiments, the metal is selected from copper, silver, zinc and combinations thereof. In some aspects of these embodiments, the metal is a combination of copper and silver. In some aspects of these embodiments, the metal is a combination of zinc and silver. In some aspects of these embodiments, the metal is silver.

In some embodiments of the present invention, the multicomponent fiber exhibits a sheath/core configuration, wherein the average particle size of the antimicrobial composition is ≦33%; alternatively ≦25%; alternatively ≦20%; alternatively ≦15% of the average thickness of the sheath.

In some embodiments of the present invention, the multicomponent fiber exhibits a sheath/core configuration, wherein the sheath comprises ≧0.01 wt %; alternatively 0.01 to 100 wt %; alternatively 0.01 to 90 wt %; alternatively 0.01 to 80 wt %; alternatively 0.01 to 75 wt %; alternatively 0.01 to 70 wt %; alternatively 0.01 to 50 wt %; alternatively 0.01 to 30 wt %; alternatively 0.01 to 20 wt %; alternatively 0.1 to 15 wt %; alternatively 0.1 to 10 wt % antimicrobial composition.

In some embodiments of the present invention, the multicomponent fiber exhibits a sheath/core configuration, wherein the sheath comprises ≦80%; alternatively ≦75%; alternatively ≦70%; alternatively ≦60%; alternatively ≦50%; alternatively ≦40%; alternatively ≦30%; alternatively ≦25%; alternatively ≦20%; alternatively ≦10%; alternatively ≧30% of the average cross-sectional area of the multicomponent fiber.

In some embodiments of the present invention, the multicomponent fiber exhibits a sheath/core configuration, wherein the sheath comprises ≦30 wt %; alternatively ≦25 wt %; alternatively ≦20 wt %; alternatively ≦15 wt %; alternatively ≦10 wt %; alternatively ≦5 wt % of the multicomponent fiber.

In some embodiments of the present invention, the multicomponent fiber exhibits a cross section selected from a pie wedge configuration, a hollow pie wedge configuration and an islands-in-a-sea configuration. In some aspects of these embodiments, the multicomponent fiber exhibits a cross section selected from a standard pie wedge configuration and a hollow pie configuration, wherein the multicomponent fiber comprises ≧2; alternatively ≧4; alternatively ≧6; alternatively ≧8; alternatively 2 to 64; alternatively 2 to 32; alternatively 2 to 16; alternatively 2 to 8; alternatively 16 to 32 pie wedge segments. In some aspects of these embodiments, the multicomponent fiber exhibits a cross section with an islands-in-a-sea configuration which comprises ≧300; alternatively 2 to 1,200; alternatively 2 to 650; alternatively 2 to 500; alternatively 2 to 400; alternatively 50 to 400; alternatively 100 to 400; alternatively 200 to 400; alternatively 300 to 400 islands.

In some aspects of these embodiments, each pie wedge segment or island comprises ≧0.01 wt %; alternatively 0.01 to 30 wt %; alternatively 0.01 to 20 wt %; alternatively 0.1 to 15 wt %; alternatively 0.1 to 10 wt % antimicrobial composition.

The fibers and multicomponent fibers of the present invention may be used in a wide variety of fabrics and textile products.

In some embodiments of the present invention, a fabric is provided comprising a fiber or multicomponent fiber of the present invention. In some aspects of these embodiments, the fabric may, optionally, further comprise at least one additional fiber, wherein the at least one additional fiber is initially free of the antimicrobial composition. In some aspects of these embodiments, the fiber or multicomponent fiber of the present invention are blended with the at least one additional fiber.

In some embodiments of the present invention, the at least one additional fiber may include, for example, natural fibers, synthetic fibers, inorganic fibers, combinations and blends thereof. The additional fibers may be of any denier; may be multi- or mono-filaments; may be false twisted or twisted; may incorporate multiple denier filaments into a single yarn through twisting and/or melting; may be multicomponent fibers exhibiting any type of cross-section, including, for example, sheath/core configurations, side by side configurations, pie wedge configurations, segmented ribon configurations, segmented cross configurations, tipped trilobal configurations and conjugate configurations.

Natural fibers suitable for use with the present invention may include, for example, silk, cotton, wool, flax, fur, hair, cellulose, ramie, hemp, linen, wood pulp and combinations thereof.

Synthetic fibers suitable for use with the present invention may be derived from materials including, for example polyolefins, such as polyethylene, polypropylene and polybutylene; halogenated polymers, such as polyvinyl chloride; polyaramids, such as poly-p-phenyleneteraphthalamid (e.g. Kevlar® fibers available from DuPont), poly-m-phenyleneteraphthalamid (e.g., Nomex® fibers available from DuPont); melamine and melamine derivatives (e.g., Basofil® fibers available from Basofil Fibers, LLC); polyesters, such as polyethylene terephthalate, polyester/polyethers; polyamides, such as nylon 6 and nylon 6,6; polyurethanes, such as Tecophilic® aliphatic thermoplastic polyurethanes available from Noveon; acetates; rayon acrylics; and combinations thereof.

Inorganic fibers suitable for use with the present invention may include, for example, fiberglass, boron fibers and rock wool.

In some embodiments of the present invention, the fabric comprises 100 wt %; alternatively ≦75 wt %; alternatively ≦50 wt %; alternatively ≦40 wt %; alternatively ≦30 wt %; alternatively ≦20 wt %; alternatively ≦10 wt %; alternatively ≦5 wt % of the fiber or multicomponent fiber of the present invention. In some aspects of these embodiments, the at least one additional fiber is selected from cotton, wool, polyester, acrylic, nylon, silk, and combinations and blends thereof.

In some embodiments of the present invention, a textile product is provided comprising a fabric of the present invention. In some aspects of these embodiments, the textile product is selected from apparel, apparel interlining, upholstery, carpeting, padding, backing, wall coverings, roofing products, house wraps, insulation, bedding, wiping cloths, towels, gloves, rugs, floor mats, drapery, napery, bar runners, textile bags, awnings, vehicle covers, boat covers, tents, agricultural coverings, geotextiles, automotive headliners, filters, envelopes, tags, labels, diapers, feminine hygene products (e.g., sanitary napkins, tampons), laundry aids (e.g., fabric dryer-sheets), wound care products and medical care products (e.g., sterile wraps, caps, gowns, masks, drapings).

In some embodiments of the present invention, a filter media is provided comprising a multicomponent fiber of the present invention. In some aspects of these embodiments, the multicomponent fiber exhibits a cross section selected from a pie wedge configuration, a hallow pie wedge configuration and an islands-in-a-sea configuration. In some aspects of these embodiments, the filter media may be used for air filtration. In some aspects of these embodiments, the filter media may be used for water filtration.

In some embodiments of the present invention, the fiber or multicomponent fiber is non-electrically conductive. In some aspects of these embodiments, the fiber or multicomponent fiber exhibits a resistance to the flow of an electrical current of ≧10,000 ohms; alternatively ≧1,000,000 ohms; alternatively $\geqq 1\times10^9$ ohms as measured in accordance with the procedure set forth in AATCC Test Method 76-1978.

In some embodiments of the present invention, at least one component polymer composition and at least one antimicrobial composition are mixed before forming the fiber or multicomponent fiber.

In some embodiments of the present invention, at least one component polymer composition and at least one antimicrobial composition are mixed during formation of the fiber or multicomponent fiber.

The fibers and multicomponent fibers of the present invention may be prepared using known fiber forming techniques suitable for use with the given component polymer composition. Some of the most prevalent fiber forming techniques include, for example, extrusion, melt-blowing, wet spinning and dry spinning. In each of these methods, the fiber raw materials are softened into a flowable state and forced through a die and/or a spinnerette to form the basic fiber, which is then typically manipulated mechanically to form the desired product fiber or multicomponent fiber. For example, the basic fiber may be stretched. In typical extrusion operations, component polymer compositions are first melted and then forced through a die and/or a spinnerette to form the basic fiber, which may then be manipulated mechanically prior to cooling to form the desired product fiber of multicomponent fiber. In typical melt blowing operations, component polymer compositions containing thermoplastic materials are first melted and then blown through a die and/or spinnerette to form the basic fiber, which is then cooled to provide the product fiber. In typical wet spinning operations, a solution of component polymer composition(s) and a solvent are forced through a die and/or spinnerette to form the basic fiber, which may then be passed through a coagulating bath (e.g., a solution of sodium sulfate in water) to provide the product fiber. In typical dry spinning operations, a solution of component polymer composition(s) and a solvent are forced through a die and/or spinnerette into air to form solid fibers. The fibers formed by these methods may, and often are, collected on a surface such as a belt to form a nonwoven web or are otherwise treated chemically or mechanically manipulated to change or enhance their physical or chemical properties.

Some embodiments of the present invention will now be described in detail in the following Examples. All fractions and percentages set forth below in the Examples are by weight unless otherwise specified.

EXAMPLE 1

Preparation of Cross-Linked Polymer Product

A polymer product was prepared using the following process: (a) 280 g reagent grade alcohol solution (90 wt % EtOH, 5 wt % MeOH, 5 wt % PrOH) was fed to a one liter kettle equipped with a stirrer, a water-cooled reflux condenser with a nitrogen gas purge outlet, a thermocouple attached to an $I^2R$ Tow TC Adapter Model TCA/1 temperature controller, a co-feed line controlled by a Harvard Apparatus 22 syringe drive and a monomer feed line controlled by QG-50 FMI pump fitted with ¼ inch tubing; (b) the contents of the kettle were heated to 80° C. with constant gentle agitation; (c) a monomer mixture containing 40 g lauryl acrylate, 40 g 1-vinylimidazole, 10 g acrylic acid and 10 g trimethylolpropane triacrylate in reagent grade alcohol solution (25 g) was fed to the kettle at a constant rate over 2 hours and a solution of t-amyl peroxypivalate (Triganox® 125-C75 available from Akzo Noble Polymer Chemicals) (2 g) in reagent grade alcohol solution (30 g) was co-fed to the kettle at a constant rate over 2 hours; (d) the product of (c) was maintained at 80° C. with constant gentle agitation for a period of thirty minutes; (e) t-amyl peroxypivalate (2 g) was fed to the kettle; (f) the product of (e) was maintained at 80° C. with constant gentle agitation for a period of thirty minutes; (g) t-amyl peroxypivalate (2 g) was fed to the kettle; (h) the product of (g) was maintained at 80° C. with constant gentle agitation for a period of thirty minutes; (i) t-amyl peroxypivalate (2 g) was fed to the kettle; (j) the product of (i) was maintained at 80° C. with constant gentle agitation for a period of thirty minutes; and, (k) the product of (j) was allowed to cool to room temperature, giving the polymer product as a polymer solution containing 21 wt % polymer solids.

EXAMPLE 2

Preparation of Antimicrobial Composition

An antimicrobial composition comprising silver complexed with a crosslinked imidazole containing polymer was prepared as follows: (a) to a uniform 10 g sample of the product polymer solution of Example 1 was added 2.0 g of an aqueous ammonium hydroxide solution (28 wt %); (b) an aqueous solution of silver nitrate (0.43 g $AgNO_3$ in 0.5 g of deionized water) was added to the product of (a) with agitation forming a product clear, light yellow colored solution containing 2.13 wt % silver; and, (c) the product of (b) was then dried in a vacuum oven at 60° C. for 48 hours leaving a dried solid containing 8.98 wt % silver and exhibiting a uniform grain size similar to that of table salt.

EXAMPLE 3

Preparation of Non-Cross-Linked Polymer Product

A polymer product was prepared using the following process: (a) 280 g reagent grade alcohol solution (90 wt % EtOH, 5 wt % MeOH, 5 wt % PrOH) was fed to a one liter kettle equipped with a stirrer, a water-cooled reflux condenser with a nitrogen gas purge outlet, a thermocouple attached to an $I^2R$ Tow TC Adapter Model TCA/1 temperature controller, a co-feed line controlled by a Harvard Apparatus 22 syringe drive and a monomer feed line controlled by QG-50 FMI pump fitted with ¼ inch tubing; (b) the contents of the kettle were heated to 80° C. with constant gentle agitation; (c) a monomer mixture containing 45 g lauryl acrylate, 45 g 1-vinylimidazole and 10 g acrylic acid in reagent grade alcohol (25 g) was fed to the kettle at a constant rate over 2 hours and a solution of t-amyl peroxypivalate (Triganox® 125-C75 available from Akzo Noble Polymer Chemicals) (2 g) in reagent grade alcohol solution (30 g) was co-fed to the kettle at a constant rate over 2 hours; (d) the product of (c) was maintained at 80° C. with constant gentle agitation for a period of thirty minutes; (e) t-amyl peroxypivalate (2 g) was fed to the kettle; (f) the product of (e) was maintained at 80° C. with constant gentle agitation for a period of thirty minutes; (g) t-amyl peroxypivalate (2 g) was fed to the kettle; (h) the product of (g) was maintained at 80° C. with constant gentle agitation for a period of thirty minutes; (i) t-amyl peroxypivalate (2 g) was fed to the kettle; (j) the product of (i) was maintained at 80° C. with constant gentle agitation for a period of thirty minutes; and, (k) the product of (j) was allowed to cool to room temperature, giving the polymer-product as a polymer solution containing 21 wt % polymer solids.

EXAMPLE 4

Preparation of Antimicrobial Composition

An antimicrobial composition comprising silver complexed with a crosslinked imidazole containing polymer was prepared as follows: (a) to a uniform 10 g sample of the product polymer solution of Example 3 was added 2.0 g of an aqueous ammonium hydroxide solution (28 wt %); (b) an aqueous solution of silver nitrate (0.40 g $AgNO_3$ in 0.5 g of deionized water) was added to the product of (a) with agitation forming a product clear light yellow colored solution containing 1.96 wt % silver; and, (c) the product of (b) was then dried in a vacuum oven at 60° C. for 48 hours leaving a dried solid containing 7.77 wt % silver and having a uniform grain size similar to that of table salt.

EXAMPLE 5

Preparation of Polypropylene for Extrusion

The polypropylene used in each of the extrusion experiments (Examples 6-10) was isotactic polypropylene (CAS#9003-07-0) obtained from Sigma-Aldridge Corporation and was described as having an average $M_w$=~250,000 and an average $M_n$=67,000 with a reported melt index (ASTM D 1238, 230° C./2.16 kg) of 12.0 g/10 min. The isotactic polypropylene was received in pellet form and was ground using a Waring blender with dry ice to provide a uniform grain size similar to that of table salt.

EXAMPLES 6-10

Extrusions

Each of the extrusion experiments were performed using a single screw, Randcastle Microtruder, Model RCP-0625, outfitted with a strand die. The noted Randcastle Microtruder features three controllable temperature zones along the barrel and one controllable temperature zone for the die. For each of the extrusion experiments, all of the controllable temperature zones were maintained at 350° C. throughout the extrusion process. The screw, speed for the extrusion experiments was varied between 10 and 50 rpm during the extrusion process. In all of the extrusion experiments, the extrudate was pulled from the dye by hand to collect the product fibers. In all of the extrusion experiments, the product fibers exhibited a uniform consistency. Upon analysis by ICP, the product fibers exhibited the silver concentration listed in Table B.

The procedure used for each of the extrusion experiments follows:

(a) for each of the extrusion experiments, a mixture with the composition set forth in Table A was fed to the Randcastle Microtruder; and, (b) the product fiber produced using the feed mixture of (a) was pulled from the dye by hand.

TABLE A

| Component | Ex. 6 | Ex. 7 | Ex. 8 | Ex. 9 | Ex. 10 |
|---|---|---|---|---|---|
| Prod. Ex. 2 | 0.17 g | 0.85 g | 0 g | 0 g | 0 g |
| Prod. Ex. 4 | 0 g | 0 g | 0.19 g | 0.95 g | 0 g |
| Prod. Ex. 5 | 150 g | 150 g | 150 g | 150 g | 150 g |

TABLE B

| Product fiber from | Silver content |
|---|---|
| Ex. 6 | 67 ppm |
| Ex. 7 | 345 ppm |
| Ex. 8 | 97 ppm |
| Ex. 9 | 443 ppm |
| Ex. 10 | 0 ppm |

We claim:

1. A method for making a fiber comprising:

(a) providing a component polymer composition;

(b) providing an antimicrobial composition comprising a metal complexed with a complexing polymer, wherein the metal is selected from copper, silver and combinations thereof; and, wherein the complexing polymer comprises a copolymer of (a) 1-vinylimidazole and (b) at least one monomer that does not contain an unsaturated or aromatic heterocyclic group;

(c) mixing the component polymer composition of (a) and the antimicrobial composition of (b);

(d) forming the fiber using the product of (c).

2. The method of claim 1, wherein the component polymer composition and the antimicrobial composition are mixed during formation of the fiber.

3. The method of claim 1, wherein the fiber is formed in (d) by a technique selected from extrusion, melt-blowing, wet spinning and dry spinning.

4. The method of claim 1, wherein the fiber is a multicomponent fiber and wherein the fiber exhibits a cross section selected from a sheath/core configuration, a side by side configuration, a pie wedge configuration, a hollow pie wedge configuration, a segmented ribon configuration, a segmented cross configuration, an islands-in-a-sea configuration, a tipped trilobal configuration and a conjugate configuration.

5. The method of claim 4, wherein the fiber exhibits a sheath/core configuration and wherein the sheath comprises the antimicrobial composition.

6. The method of claim 1, further comprising:

providing a disinfecting agent selected from alcohols, quaternary ammonium disinfectants, phenolic disinfectants, halide based disinfectants, biguanide disinfectants, chlorhexidine disinfectants, iodophor disinfectants, citric acid disinfectants, peroxide disinfectants and combinations thereof; and, including the disinfecting agent in the fiber.

* * * * *